US005340073A

United States Patent [19]

Masakazu

[11] Patent Number: 5,340,073

[45] Date of Patent: Aug. 23, 1994

[54] DISPLAY SUPPORTING DEVICE

[75] Inventor: Kuki Masakazu, Ichinomiya, Japan

[73] Assignee: Brother Kogyo Kabushiki Kaisha, Nagoya, Japan

[21] Appl. No.: 18,555

[22] Filed: Feb. 17, 1993

[30] Foreign Application Priority Data

Apr. 28, 1992 [JP] Japan ..... 4-110388

[51] Int. Cl.[5] ..... E04G 3/00

[52] U.S. Cl. ..... 248/291; 248/442.2; 403/103; 403/120

[58] Field of Search ..... 248/291, 284, 286, 292.1, 248/293, 442.2, 282, 289.1; 403/103, 84, 83, 112, 119, 120; 400/83

[56] References Cited

U.S. PATENT DOCUMENTS 4,712,870 12/1987 Robinson et al. ..... 248/286 X
4,808,017 2/1989 Sherman et al. ..... 400/83
5,122,941 6/1992 Gross et al. ..... 248/442.2 X

FOREIGN PATENT DOCUMENTS

0445635A1 9/1991 European Pat. Off. .
2335000 1/1975 Fed. Rep. of Germany .
2830817 1/1980 Fed. Rep. of Germany .
2166796A 5/1986 United Kingdom .

*Primary Examiner*—Ramon O. Ramirez
*Attorney, Agent, or Firm*—Oliff & Berridge

[57] ABSTRACT

To prevent rapid movement of a display in any direction even in the condition where the display is movable. A display supporting device includes a frictional force generating portion for generating frictional force in a direction opposite to a moving direction of a display when moving the display relative to a body of equipment, and biasing structure for applying a biasing force not less than a predetermined value to the frictional force generating portion in a direction perpendicular to the moving direction to make magnitude of the frictional force to be generated in the frictional force generating portion at least not less than a moving force.

12 Claims, 7 Drawing Sheets

DISPLAY SUPPORTING DEVICE

BACKGROUND OF THE INVENTION

1. Field of the Invention

The invention relates to a display supporting device for movably supporting a display on a body of a text processing system or the like.

2. Description of Related Art

FIG. 5 shows a text processing system having a body 5 and a display 1 that is rotatably supported on the body 5 so as to be kept in an arbitrary rotational position.

The body 5 of the text processing system is provided at its upper front portion with a keyboard 20 for inputting text, and is also provided with an insert opening and an eject opening behind the keyboard 20 for inserting and ejecting the printing paper. The body 5 is further provided at its right side portion with a display supporting device for supporting the display 1 on the body 5, whereby the display 1 is rotatably supported on the body 5 so as to be able to be moved to an arbitrary, operator selected rotational position and then fixed at that position.

The structure of a known display supporting device for a text processing system as described above will be described with reference to FIGS. 6 and 7.

FIG. 6 is a partially cutaway sectional view of the text processing system having the conventional display supporting device.

In this text processing system, a generally U-shaped frame 10 is fixed by screws to a lower cover 8, of the body 5, and an arm shaft 6 is fixed to the frame 10. A joint 2 for supporting the display 1 through an arm pipe 3 is rotatably supported on the arm shaft 6. The joint 2 is prevented from axially disengaging from the arm shaft 6 by inserting a screw 40 through the joint 2 into a circumferential groove 41 formed on the arm shaft 6.

A friction plate 13 is rotatably supported on the arm shaft 6 on the left side (as viewed in FIG. 6) of the joint 2. The friction plate 13 is formed on its right side surface with a plurality of projections 11, and the joint 2 is formed at its left end, adjacent to the right side surface of the friction plate 13, with a plurality of holes for respectively engaging the projections 11 of the friction plate 13, whereby the friction plate 13 is rotatable together with the joint 2.

An annular cork plate 12 is rotatably supported on the arm shaft 6 between the friction plate 13 and a right vertical portion of the frame 10.

A torque spring guide 17 is fixed by a screw 18 to the arm shaft 6 between the right and left vertical portions of the frame 10. A torque spring 16 is mounted on the arm shaft 6 between the torque spring guide 17 and the right vertical portion of the frame 10. The torque spring 16 is fixed at its one end to the friction plate 13 and is fixed at the other end to the torque spring guide 17. As viewed in FIG. 5, the torque spring 16 serves to normally bias the display 1 in a clockwise direction through the friction plate 13, the joint 2 and the arm pipe 3, thereby preventing the display 1 from rapidly falling down in the forward direction, that is toward the keyboard 20.

The arm shaft 6 is formed at its right end portion with external threads 14. A knob 4, having internal threads, is fastened to the external threads 14 of the arm shaft 6 so as to axially leftwardly urge the joint 2 through a washer 15.

The joint 2, the friction plate 13, the cork plate 12, the frame 10 and the torque spring 16, arranged between the torque spring guide 17 and the washer 15, are forced into a contact relationship with each other by the fastening force of the knob 4 with the force having a variable strength depending upon an extent of screw fastening of the knob 4.

Thus, the strength of the maximum frictional force generated between the contact surfaces (frictional force generating portion) of the frame 10 and the cork plate 12 and the strength of the maximum frictional force generated between the contact surfaces (frictional force generating portion) of the cork plate 12 and the friction plate 13 are dependent upon the screw fastening force applied by the knob 4.

Accordingly, when the knob 4 is loosened by a user, to decrease the fastening force, it decreases the maximum frictional force and the display 1 may be rotated relative to the body 5 to any position desired by the user. Thereafter, when the knob 4 is tightened by the user, to increase the fastening force, it increases the maximum frictional force and the display 1 is fixed at the desired position so that the user may operate the text processing system with the display 1 fixed at the desired position.

Further, in the above conventional text processing system, the display 1 is prevented from rapidly falling down in the forward direction, even in the loosened condition of the knob 4, but it is not prevented from rapidly rotating in the rearward direction.

Accordingly, when standing the text processing system on a surface 21 and the knob 4 is in a loosened condition, as shown in FIG. 7, the display 1 rapidly rotates toward the surface 21 by a rotation moment W1, caused by gravity's effect on the display 1 and the arm pipe 3, and a rotation moment T1, due to the torque spring 16. Thus, there is a possibility that the display 1 may strike against the surface 21 and be broken.

SUMMARY OF THE INVENTION

The invention has been made to solve the above problem. It is an object of the invention to provide a display supporting device which can prevent the display from rapidly moving in any direction, even in the condition where the display is movable relative to the body of the text processing system.

According to the invention to achieve the above object, there is provided a display supporting device for movably supporting a display on a body of equipment: comprising a frictional force generating portion for generating frictional force in a direction opposite to a moving direction of the display when moving the display relative to the body; and biasing means for applying biasing force not less than a predetermined value to the frictional force generating portion in a direction perpendicular to the moving direction to make a magnitude of the frictional force to be generated in the frictional force generating portion become at least not less than a predetermined value.

The display is movably supported on the body by the display supporting device. The frictional force generating portion generates a frictional force in a direction opposite to a moving direction of the display. The biasing means applies a biasing force, not less than a predetermined value, to the frictional force generating portion in a direction perpendicular to the moving direction of the display, thereby making the magnitude of the frictional force to be generated in the frictional force generating portion become at least not less than a predetermined value.

BRIEF DESCRIPTION OF THE DRAWINGS

The invention will be described with reference to the following drawings, wherein.

DETAILED DESCRIPTION OF THE PREFERRED EMBODIMENTS

A preferred embodiment of the invention will be described with reference to the drawings.

Figure 5:
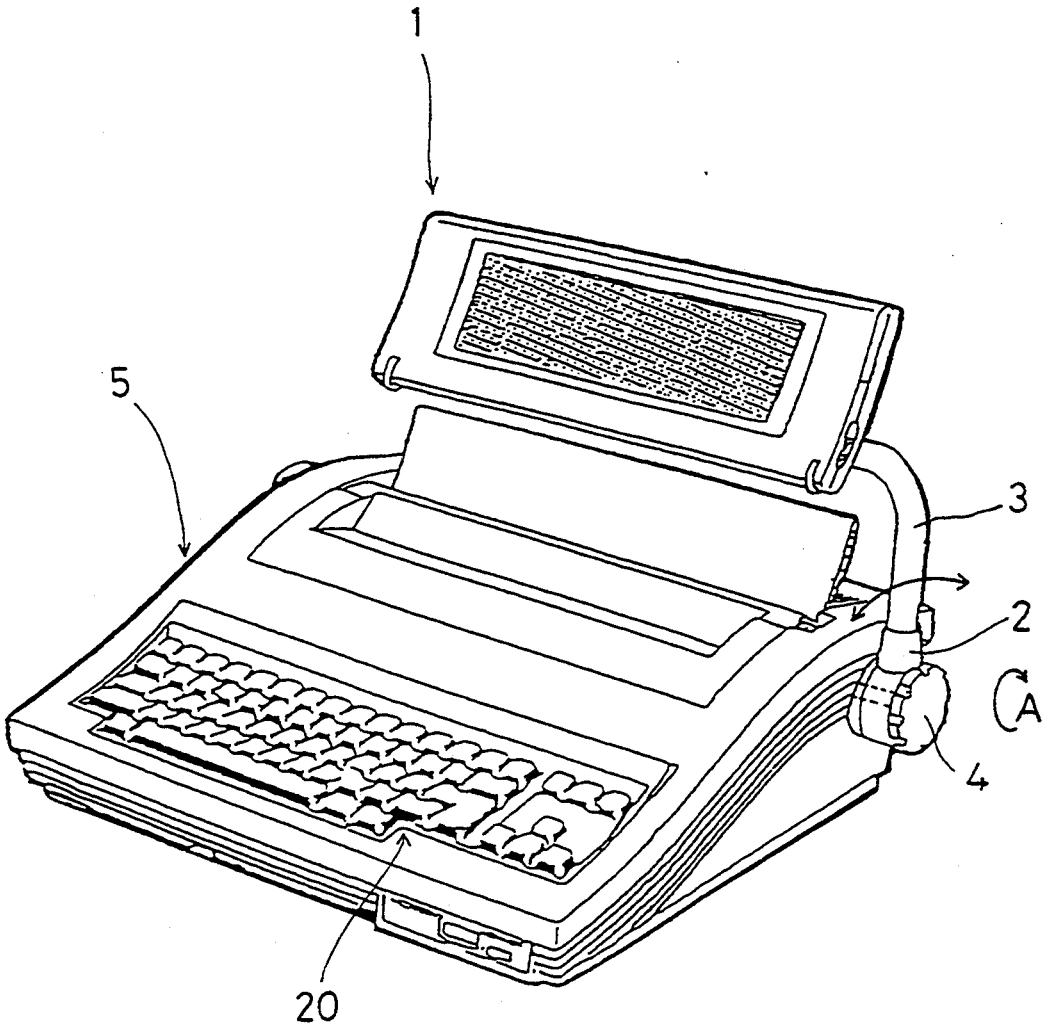
FIG. 5 is a perspective view of the text processing system, illustrating the external structure thereof.
Figure 6:
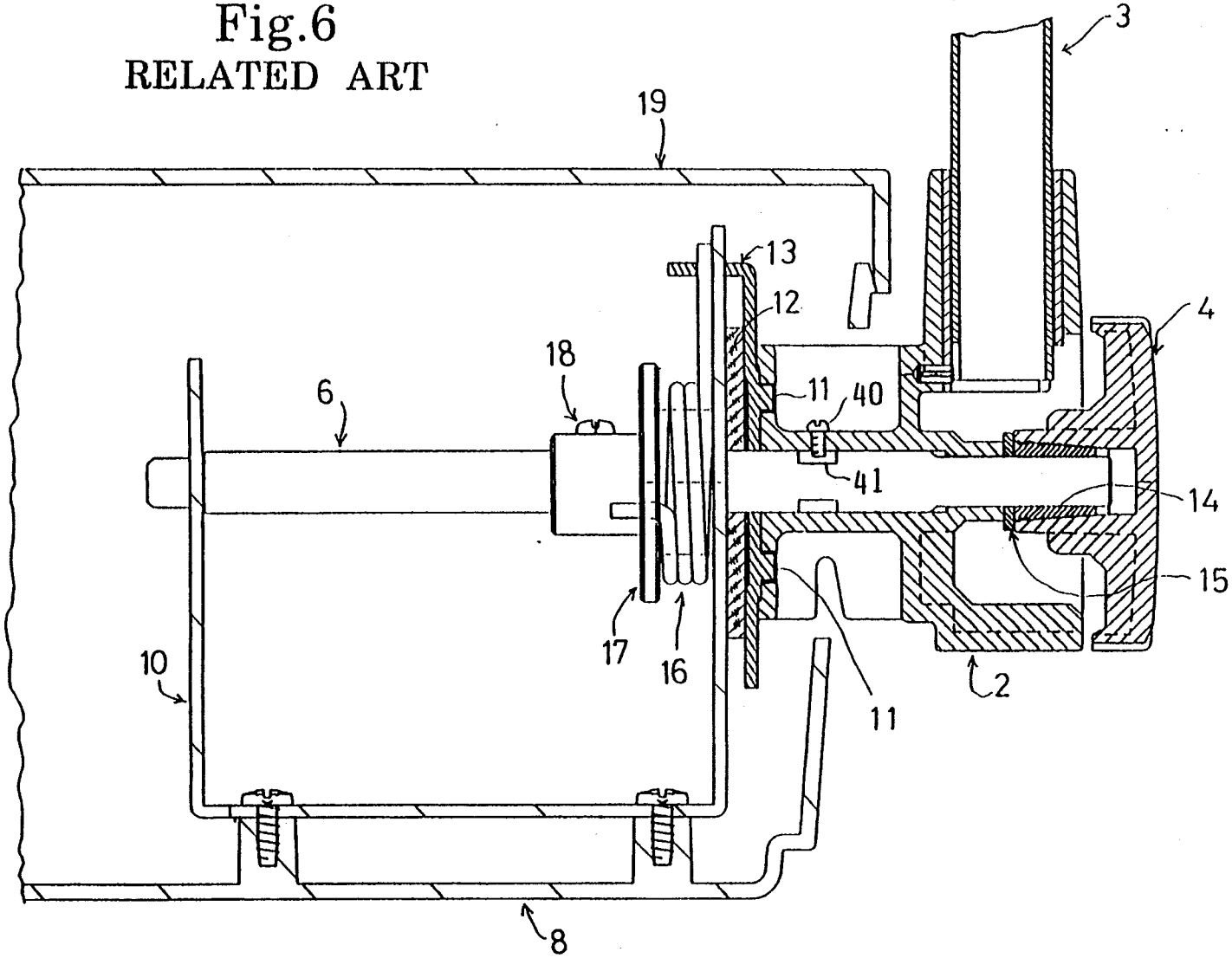
Fig.6 RELATED ART
FIG. 6 is a partially cutaway sectional view of a text processing system provided with the display supporting device of the related art.
Figure 7:
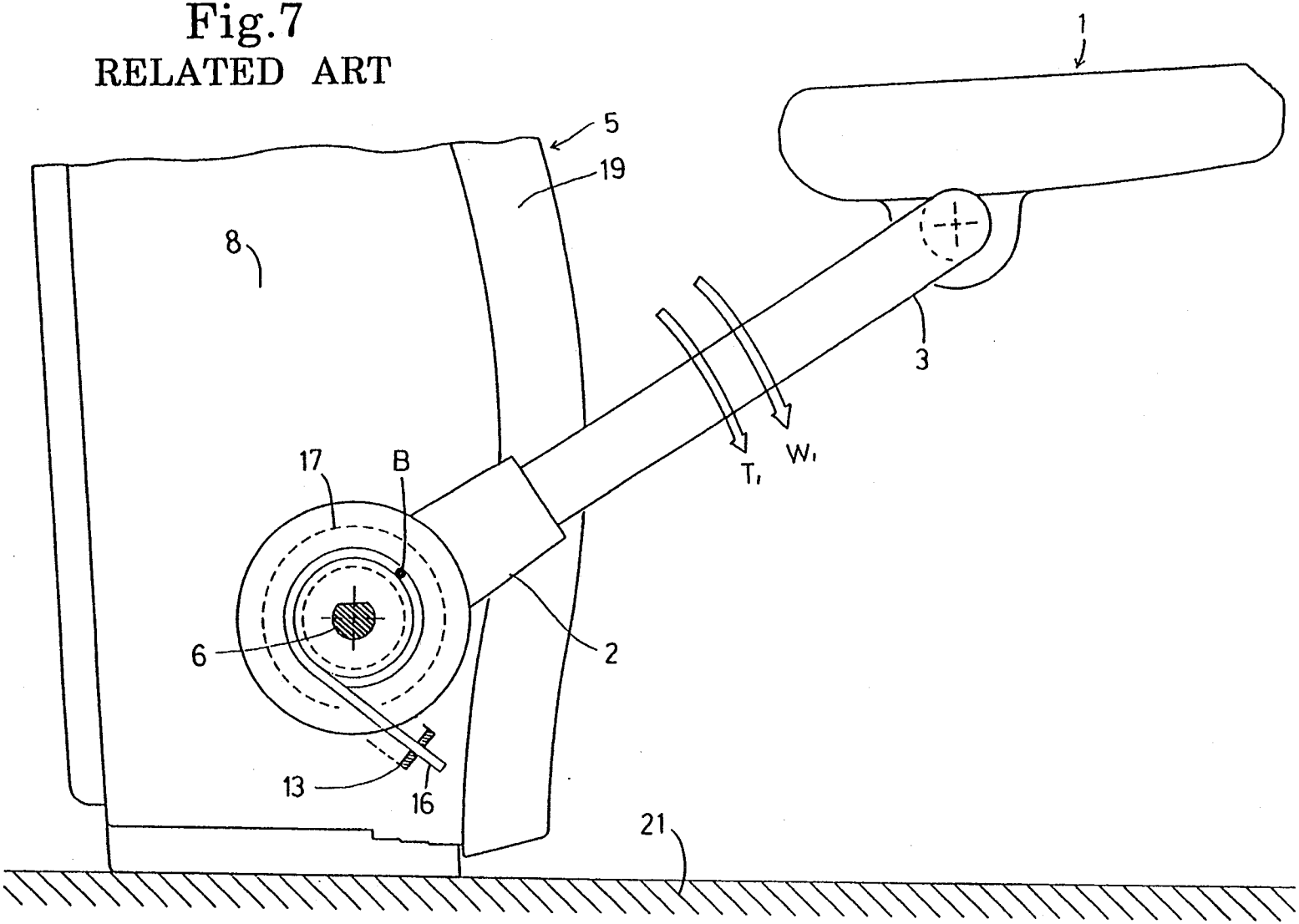
Fig.7 RELATED ART
FIG. 7 is a side view of the text processing system shown in FIG. 6 in the condition where the display is located at a forward tilted position over the text processing system body disposed vertically on the surface.

The external structure of a text processing system to which the preferred embodiment of the invention is applied as shown in FIG. 5 and was described above prior to the detailed description of the display supporting device of the related art. Therefore, another explanation will be omitted.

Figure 1:
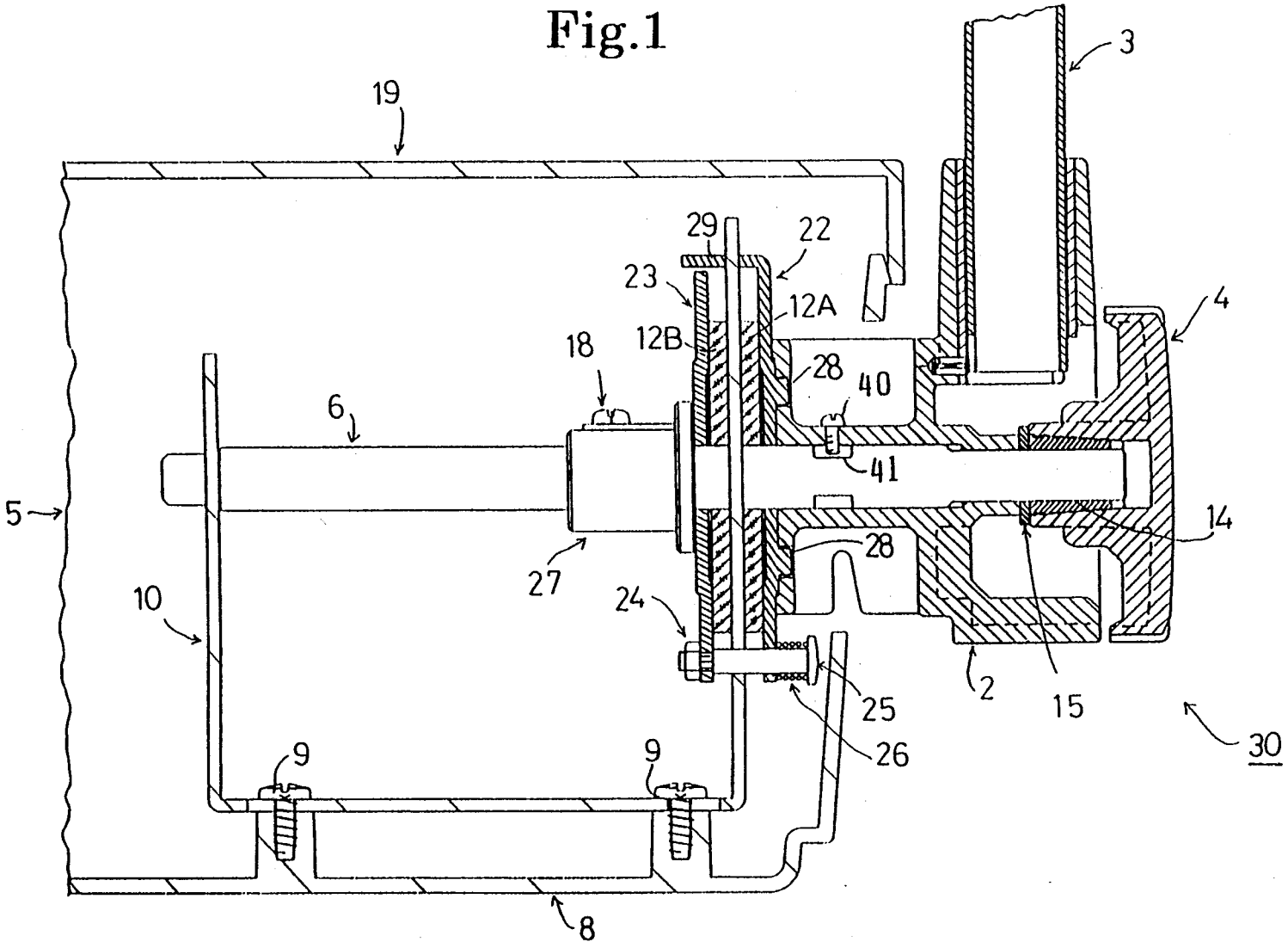
FIG. 1 is a partially cutaway sectional view of a text processing system provided with the display supporting device in a preferred embodiment according to the invention.
Figure 2:
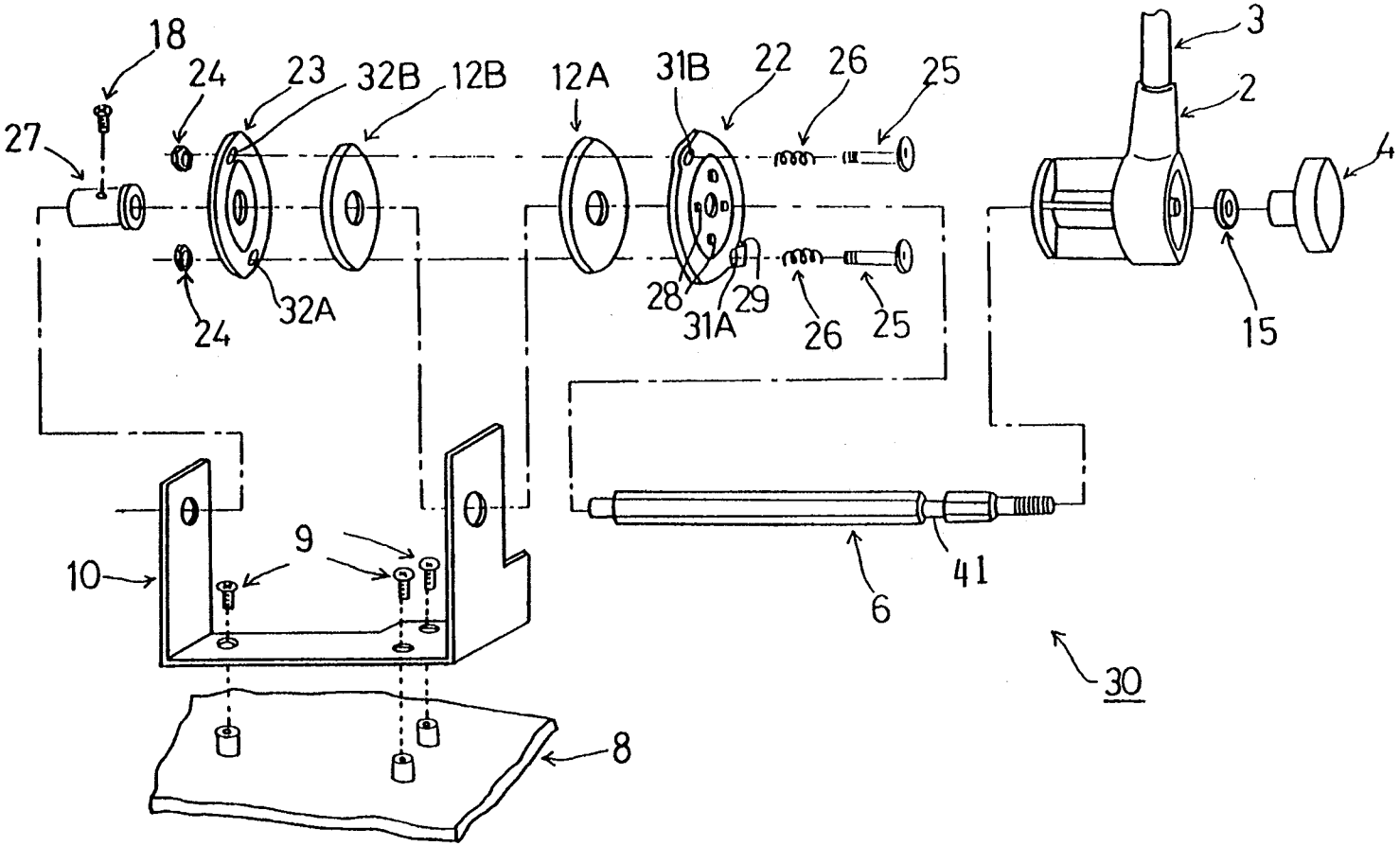
FIG. 2 is an exploded perspective view of the display supporting device.

FIG. 1 is a partially cutaway sectional view of the text processing system provided with a display supporting device 30 in the preferred embodiment according to the invention. FIG. 2 is an exploded perspective view of the display supporting device 30.

Referring to FIG. 1, a generally U-shaped frame 10 of the display supporting device 30 is fixed by screws 9 to a lower cover 8 of a body 5 of the text processing system. An arm shaft 6 is fixed to the frame 10. A joint 2 is rotatably supported on the arm shaft 6 and a display 1 is supported, through an arm pipe 3, on the joint 2. The joint 2 is prevented from axially disengaging from the arm shaft 6 by inserting a screw 40 through the joint 2 into a circumferential groove 41 formed on the arm shaft 6.

A first friction plate 22 is rotatably supported on the arm shaft 6 to the immediate left of and adjacent to (as viewed in FIG. 1) the joint 2.

As shown in FIG. 2, the first friction plate 22 is provided at its central portion with a through hole through which the arm shaft 6 is inserted. The first friction plate 22 is further provided, at its outer peripheral portion, with two through holes 31A, 31B through which shoulder bolts 25, to be described later, are inserted. The two through holes 31A, 31B are located at diametrically opposite positions with respect to the central portion of the first friction plate 22.

A left side surface of the first friction plate 22, adjacent to a first cork plate 12A to be hereinafter described, is recessed at its central portion around the central through hole. Owing to the recess of the first friction plate 22, only the outer peripheral portion of the left side surface of the first friction plate 22 is maintained in frictional contact with the first cork plate 12A, the recess not being in frictional contact with first cork plate 12A.

A right side surface of the first friction plate 22, adjacent to the joint 2, is provided with four projections 28. As shown in FIG. 1, the four projections 28 are respectively engaged with four holes formed through a left end of the joint 2 so that the first friction plate 22 is rotatable together with the joint 2.

The first friction plate 22 is provided at its outer periphery, near the through hole 31A, with a rotation stopper 29 projecting leftwardly so as to be able to contact the frame 10.

An angle of rotation of the first friction plate 22, in association with rotation of the joint 2, is limited to about 100 degrees between a position where the rotation stopper 29 contacts an upper portion of the frame 10, above the arm shaft 6, and another position where the rotation stopper 29 contacts a lower portion of the frame 10 below the arm shaft 6. The limitation of the rotational angle of the first friction plate 22 permits a limited movement of the display 1, connected through the joint 2 and the arm pipe 3 to the first friction plate 22, between a first position where a display surface of the display 1 faces an upper cover 19 of the body 5 at a substantially central portion thereof and a second position where the display 1 is located above and just behind the body 5 (see FIG. 3, dash-dot line).

The first cork plate 12A, having an annular shape, is rotatably mounted on the arm shaft 6 between the first friction plate 22 and a right vertical portion of the frame 10.

An axial stopper 27 is fixed by a screw 18 to the arm shaft 6 between the right and left vertical portions of the frame 10.

A second friction plate 23 and a second cork plate 12B, having an annular shape, are rotatably supported on the arm shaft 6 between the axial stopper 27 and the right vertical portion of the frame 10.

As shown in FIG. 2, the second friction plate 23 is provided at its central portion with a through hole through which the arm shaft 6 is inserted. The second friction plate 23 is further provided at its outer peripheral portion with two through holes 32A and 32B through which the shoulder bolts 25 are respectively inserted. The through holes 32A and 32B are located at diametrically opposite positions with respect to the central portion of the second friction plate 23 so as to be respectively aligned with the through holes 31A and 31B of the first friction plate 22.

A right side surface of the second friction plate 23, adjacent to the second cork plate 12B, is recessed at its central portion around the central through hole. Owing to the recess of the second friction plate 23, only the outer peripheral portion of the right side surface of the second friction plate 23 is maintained in frictional contact with the second cork plate 12B, the recess not being in frictional contact.

The frictional force generating portion, according to the invention, comprises the contact surfaces of the first friction plate 22 and the first cork plate 12A, the contact surfaces of the second friction plate 23 and the second cork plate 12B, the contact surfaces of the frame 10 and the first cork plate 12A, and the contact surfaces of the frame 10 and the second cork plate 12B.

As shown in FIG. 1, one of the shoulder bolts 25 is inserted through the through hole 31A of the first friction plate 22 and the through hole 32A of the second friction plate 23, and the other shoulder bolt 25 is inserted through the through hole 31B of the first friction plate 22 and the through hole 32B of the second friction plate 23. A compression spring 26 is mounted on each shoulder bolt 25 in such a manner as to be interposed between a head portion of each shoulder bolt 25 and the first friction plate 22. Each shoulder bolt 25 is tightened at its tip portion with a nut 24 to be fixed to the second friction plate 23. Accordingly, the second friction plate 23 is rotatable together with the first friction plate 22.

The first friction plate 22 is normally biased by a known biasing force of the two compression springs 26 in the axial direction of the arm shaft 6 toward the second friction plate 23.

The biasing force of the compression springs 26 defines the strength of maximum frictional force to be generated between the contact surfaces (the frictional force generating portion) of the frame 10 and the first cork plate 12A, between the contact surfaces (the frictional force generating portion) of the frame 10 and the second cork plate 12B, between the contact surfaces (the frictional force generating portion) of the first cork plate 12A and the first friction plate 22, and between the contact surfaces (the frictional force generating portion) of the second cork plate 12B and the second friction plate 23. The frictional force generated acts in a direction opposite to any rotating direction of the display 1 as rotated by the user, thus preventing undesired rotation of the display 1.

The arm shaft 6 is provided at its right end portion with external threads 14. A knob 4 having internal threads is fastened to the external threads 14 so as to axially urge the joint 2 leftwardly via a washer 15.

By adjusting the degree of screw fastening of the knob 4 to the external threads 14, the first friction plate 22, the first cork plate 12A, the frame 10, the second cork plate 12B and the second friction plate 23 can be maintained in frictional contact with each other by a fastening force produced by the knob 4 which is larger than the biasing force of the compression springs 26.

The fastening force of the knob 4 defines the strength of frictional forces to be generated between the contact surfaces of the frame 10 and the first cork plate 12A, between the contact surfaces of the frame 10 and the second cork plate 12B, between the contact surfaces of the first cork plate 12A and the first friction plate 22, and between the contact surfaces of the second cork plate 12B and the second friction plate 23. The frictional force generated upon fully screw fastening the knob 4 are larger than those due to the biasing force of the compression springs 26 and enough to fix the display 1 in position.

The biasing means according to the invention is comprised of the nuts 24, the shoulder bolts 25, the compression springs 26, the axial stopper 27, the external threads 14 of the arm shaft 6, the internal threads of the knob 4, the washer 15, and the joint 2.

The operation of the display supporting device 30 having the above structure will now be described.

Figure 3:
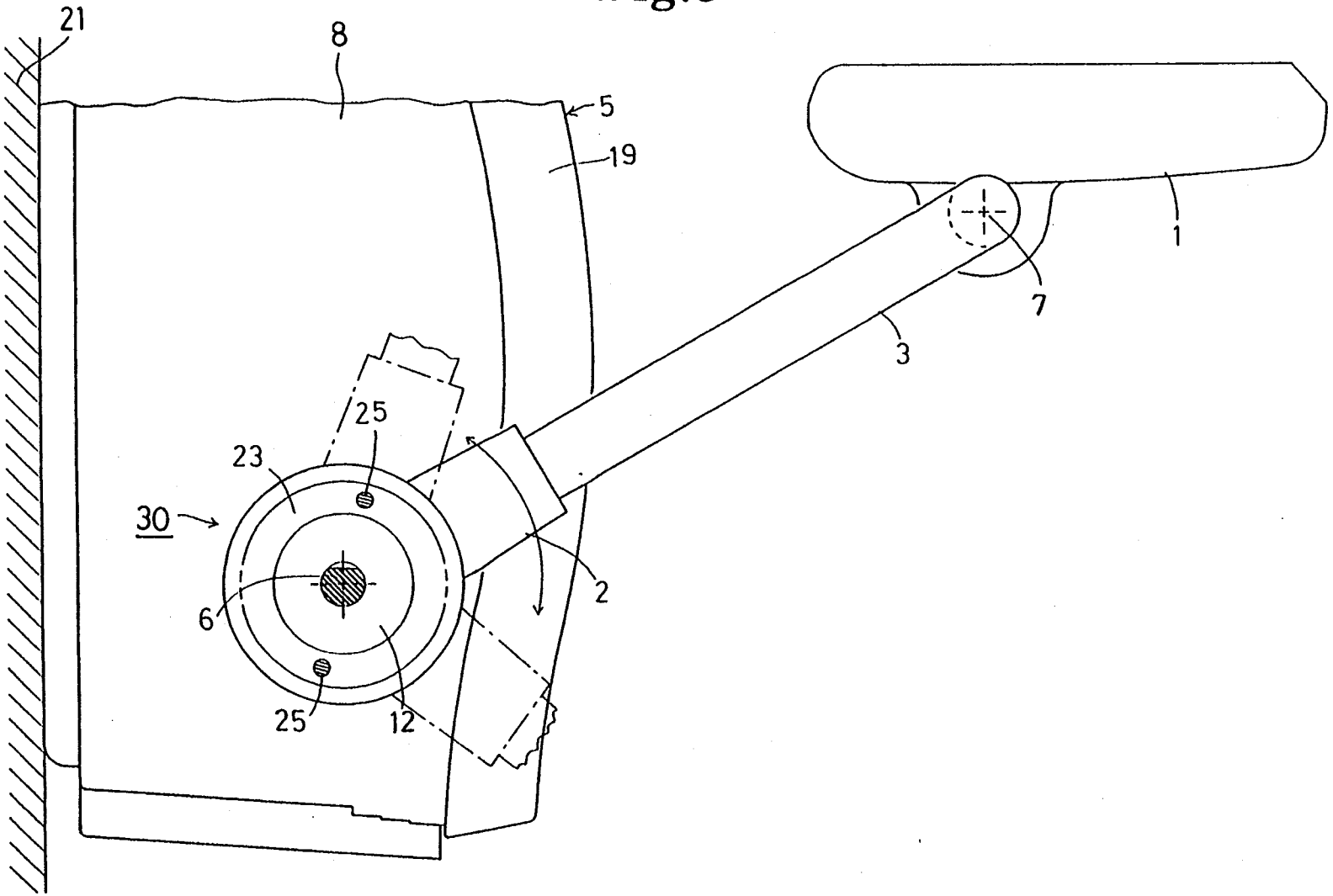
FIG. 3 is a side view of the text processing system in the condition where the display is located at a forward tilted position over the text processing system body disposed horizontally on a surface.
Figure 4:
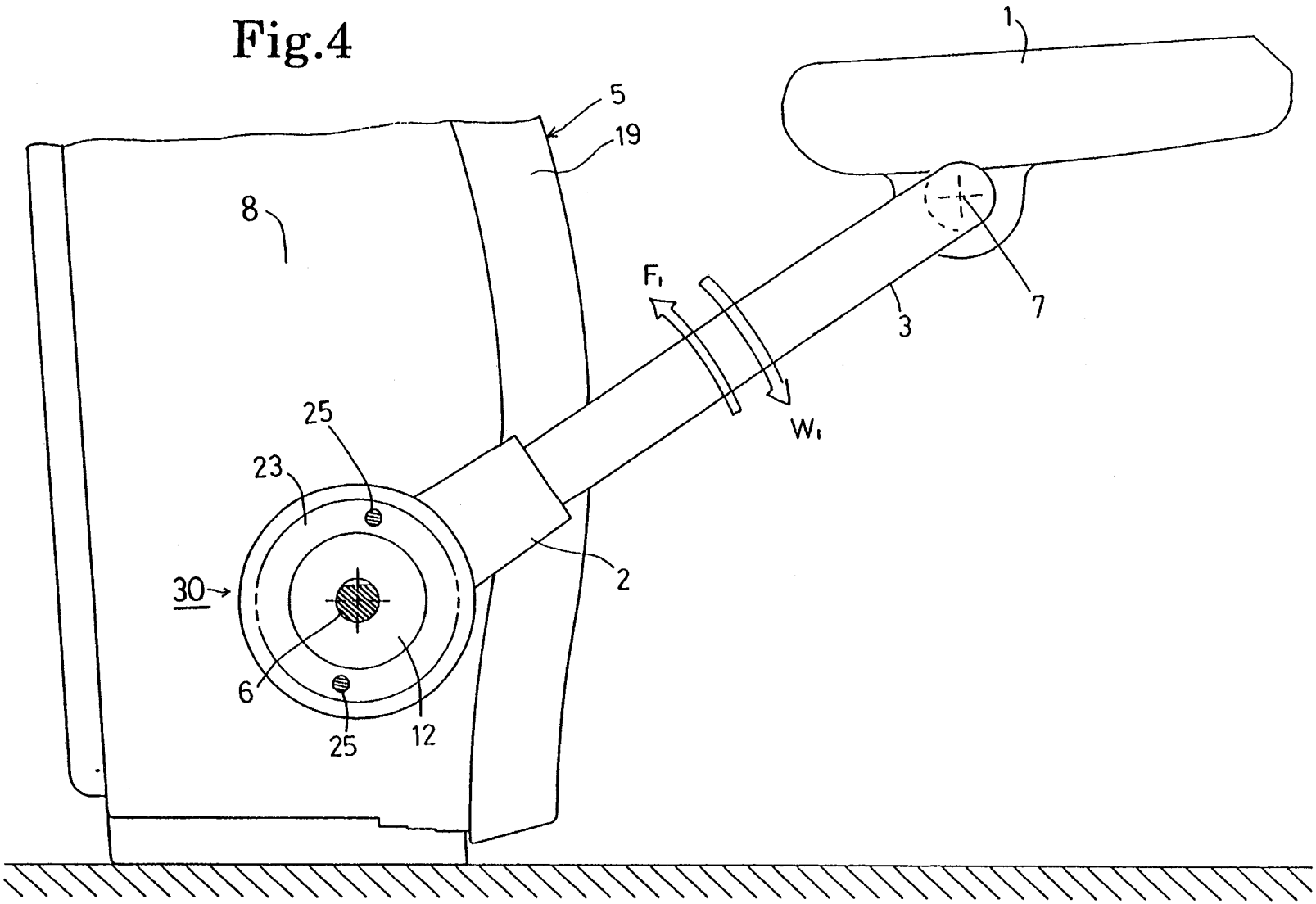
FIG. 4 is a side view of the text processing system in the condition where the display is located at the forward tilted position over the text processing system body disposed vertically on the surface.

FIG. 3 is a side view of the text processing system in the condition where the display 1 is located in a forward tilted position over the text processing system body 5 which is disposed horizontally, that is, in a working posture, on a surface 21. FIG. 4 is a side view of the text processing system in the condition where the display 1 is located at the forward tilted position over the body 5 which is disposed vertically, that is, in a storing posture, on the surface 21.

It is assumed that the display supporting device 30 is in an initial condition where the knob 4 is fully fastened in a direction as depicted by an arrow A of FIG. 5.

In this condition, the fastening force of the knob 4 is greater than the biasing force of the compression springs 26 that is applied to the contact surfaces of the frame 10 and the first cork plate 12A, the contact surfaces of the frame 10 and the second cork plate 12B, the contact surfaces of the first cork plate 12A and the first friction plate 22, and the contact surfaces of the second cork plate 12B and the second friction plate 23. Accordingly, even when external force for rotating the display 1 is applied by the user to the display 1, the display 1 is kept non-rotatable relative to the body 5 by the frictional force generated in the display supporting device 30 owing to the fastening force of the knob 4.

The contact surfaces of the first friction plate 22 and the first cork plate 12A and the contact surfaces of the second friction plate 23 and the second cork plate 12B are formed as annular surfaces because of the recesses of the first and second friction plates 22 and 23. Therefore, assuming the fastening force of the knob 4 is fixed, the frictional force to be generated between the contact surfaces of the invention acts as resistance against rotation of the display 1 about the arm shaft 6 more effectively than would be generated in the case where the friction plates 22, 23 would have circular, or complete, contact surfaces contacting the cork plates 12A, 12B.

When the knob 4 is rotated in a direction reverse to the direction of the arrow A, shown in FIG. 5, by the user, the fastening force of the knob 4 applied to the contact surfaces of the frame 10 and the first cork plate 12A, the contact surfaces of the frame 10 and the second cork plate 12B, the contact surfaces of the first cork plate 12A and the first friction plate 22, and the contact surfaces of the second cork plate 12B and the second friction plate 23 is reduced down to the biasing force produced by the compression springs 26 alone.

Accordingly, the frictional force generated on all the contact surfaces is reduced so that the display 1 may be rotated about the arm shaft 6 by the operator.

When the proper external force is applied by the user to rotate the display 1, the display 1 is rotated about the arm shaft 6 within the given rotatable range mentioned previously and may be located at a desired position.

After thus obtaining a desired position for the display 1, the user may operate the text processing system to perform text processing. If no appropriate external force is applied by the user, or any other source, to the display 1, the display 1 will remain held in the desired position by the frictional force generated by the biasing force of the compression springs 26.

Alternatively, the user may tighten the knob 4 in the direction of the arrow A (FIG. 5) and tightly fix the display 1 at the desired position.

After completing text processing, it is assumed that the body 5 is set on a surface 21, with its front, or keyboard, end oriented upward, that is it is stored vertically, as shown in FIG. 4.

In this case, should the operator forget to store the display 1 in the forward position shown in FIG. 3, the display supporting device 30 continues to support the display 1 relative to the body 5 and keeps the previous position of the display 1 owing to the frictional force generated by the biasing force of the compression springs 26 or, even more securely, by the fastening force of the knob 4.

That is, a rotation moment W1 toward the surface 21 due to the weight of the display 1 and the arm pipe 3 and the force exerted by torque spring 16 is at least in balance with a moment F1 due to the frictional force of the compression springs 26. Therefore, the display 1 does not rapidly rotate toward the surface 21.

Accordingly, the display supporting device 30 can prevent striking of the display 1 against the surface 21 and possible breakage of the display 1 when moving or storing the text processing system.

It is to be understood that the invention is not limited to the specific embodiment illustrated above, but various modifications may be made without departing from the scope of the invention.

For example, the cork plates 12A and 12B employed in the above preferred embodiment may be replaced with rubber plates having a shape similar to that of the cork plates 12A and 12B.

As is apparent from the above description, in the display supporting device according to the invention, even in the condition where the display is movable relative to the body of the text processing system, the display can be prevented from rapidly moving in any direction to thereby avoid possible breakage of the display due to the rapid movement thereof.

What is claimed is:

1. A display supporting device for movably supporting a display on a body of equipment, comprising:

a frictional force generating portion for generating frictional force in a direction opposite to a moving direction of the display when moving the display relative to the body; and biasing means for applying biasing force not less than a predetermined value to said frictional force generating portion in a direction perpendicular to the moving direction to make a magnitude of the frictional force to be generated in said frictional force generating portion become at least not less than a predetermined value.

2. The display supporting device according to claim 1, wherein said frictional force generating portion comprises:

a first friction plate;

a friction part having first and second friction surfaces;

a first friction material between said first friction plate and said first friction surface;

a second friction plate; and a second friction material between said second friction plate and said second friction surface.

3. The display supporting device as claimed in claim 2, wherein said biasing means comprises first and second holes formed in each of said first and second friction plates;

connectors passing through paired first and second holes to connect said first and second friction plates; and tension means mounted between a head of each connector and said first friction plate to bias said first and second friction plates towards one another.

4. The display supporting device as claimed in claim 3, wherein said biasing means further comprises a second biasing means comprising a shaft passing through said first friction plate, said first friction material, said friction part, said second friction material, and said second friction plate;

a joint slidably mounted to said shaft and engaged with said first friction plate; and compressing means for compressing said first friction plate, said first friction material and said first friction surface to fix the display supporting device in a selected position.

5. The display supporting device as claimed in claim 2, wherein said first and second friction materials are selected from the group consisting of cork, rubber and flexible plastics.

6. A display supporting device for a printing apparatus comprising:

a display;

an arm for pivotally supporting said display to the printing apparatus;

a bracket mounted in a body of the printing apparatus;

an extension of said bracket having a first friction surface and a second friction surface;

a shaft mounted to said bracket and having mounted thereon:

a first friction plate;

a first friction material between said first friction plate and said first friction surface;

a second friction plate; and a second friction material between said second friction plate and said second friction surface, each of said first and second friction plates having a first and second hole therein;

connectors passing through paired first and second holes to connect said first and second friction plates; and tension means mounted between a head of each connector and said first friction plate to bias said first and second friction plates towards one another.

7. The display supporting device as claimed in claim 6, further comprising a second biasing means comprising said shaft passing through said first friction plate, said first friction material, said friction part, said second friction material, and said second friction plate;

a joint slidably mounted to said shaft and engaged with said first friction plate; and compressing means for compressing said first friction plate, said first friction material and said first friction surface to fix the display supporting device in a selected position.

8. The display supporting device as claimed in claim 6, wherein said first and second friction materials are selected from the group consisting of cork, rubber and flexible plastics.

9. A display supporting device for a printing apparatus comprising:

a display;

an arm for pivotally supporting said display to the printing apparatus;

a bracket mounted in a body of the printing apparatus;

an extension of said bracket having a first friction surface and a second friction surface;

a shaft mounted to said bracket and having mounted thereon:

a first friction plate;

a first friction material between said first friction plate and said first friction surface;

a second friction plate; and a second friction material between said second friction plate and said second friction surface; and biasing means for applying a biasing force to said first friction plate, said first friction material, said first friction surface, said second friction surface, said second friction material and said second friction plate to create a frictional force.

10. The display supporting device as claimed in claim 9, wherein said biasing means comprises first and second holes formed in each of said first and second friction plates;

connectors passing through paired first and second holes to connect said first and second friction plates; and tension means mounted between a head of each connector and said first friction plate to bias said first and second friction plates toward one another.

11. The display supporting device as claimed in claim 10, wherein said biasing means further comprises a second biasing means comprising said shaft passing through said first friction plate, said first friction material, said extension, said second friction material, and said second friction plate;

a joint slidably mounted to said shaft and engaged with said first friction plate; and compressing means for compressing said first friction plate, said first friction material and said first friction surface to fix the display supporting device in a selected position.

12. The display supporting device as claimed in claim 9, wherein said first and second friction materials are selected from the group consisting of cork, rubber and flexible plastics.

* * * * *